United States Patent [19]

Grüne et al.

[11] Patent Number: 5,071,667

[45] Date of Patent: Dec. 10, 1991

[54] METHOD OF PRESERVING FOODSTUFFS IN CUP-SHAPED CONTAINERS

[75] Inventors: Helmut Grüne; Manfred Nordmeyer, both of Schwarmstedt, Fed. Rep. of Germany; Hans Faltum, Odense, Denmark

[73] Assignee: Lieder Maschinenbau GmbH & Co. KG., Schwarmstedt, Fed. Rep. of Germany

[21] Appl. No.: 574,400

[22] Filed: Aug. 27, 1990

Related U.S. Application Data

[63] Continuation of Ser. No. 74,757, Jul. 17, 1987, abandoned.

[30] Foreign Application Priority Data

Jul. 24, 1986 [DE] Fed. Rep. of Germany ..... 3625081

[51] Int. Cl.[5] ..... B65B 55/18; B65D 51/16

[52] U.S. Cl. ..... 426/396; 53/84; 53/425; 53/432; 53/510; 426/232; 426/316; 426/418

[58] Field of Search ..... 426/392, 396, 418, 410, 426/419, 316, 404, 232; 53/425, 433, 426, 434, 432, 510–512, 84

[56] References Cited

U.S. PATENT DOCUMENTS

| | | | |
|---|---|---|---|
| 1,821,106 | 9/1931 | Milani | 426/419 |
| 2,723,200 | 11/1955 | Pyenson | 426/392 |
| 3,695,900 | 10/1972 | Young et al. | 426/396 |
| 3,715,860 | 2/1973 | Esty | 426/418 |
| 3,942,301 | 3/1976 | Domke | 53/510 |
| 3,943,987 | 3/1976 | Rossi | 53/432 |
| 3,992,850 | 11/1976 | Vetter | 53/510 |
| 4,027,707 | 6/1977 | Maskell | 53/84 |
| 4,294,859 | 10/1981 | Lundquist et al. | 53/433 |
| 4,409,252 | 10/1983 | Buschkens et al. | 426/396 |
| 4,588,000 | 5/1986 | Malin et al. | 53/432 |
| 4,627,336 | 12/1986 | Nam | 53/510 |
| 4,659,578 | 4/1987 | Schlegel | 426/418 |
| 4,662,154 | 5/1987 | Hayward | 53/510 |
| 4,703,609 | 11/1987 | Yoshida et al. | 53/432 |

FOREIGN PATENT DOCUMENTS

| | | | |
|---|---|---|---|
| 0228438 | 6/1960 | Australia | 426/418 |
| 3114508 | 11/1982 | Fed. Rep. of Germany | 426/418 |
| 0393935 | 6/1933 | United Kingdom | 426/418 |

OTHER PUBLICATIONS

Walker, "How Nitrogen Protects the Quality of Foods," Food Industries, Sep. 1949 vol. pp. 37 & 38, 1189 & 1190.

*Primary Examiner*—Virginia Monoharan
*Attorney, Agent, or Firm*—Peter K. Kontler

[57] ABSTRACT

Open-top cup-shaped containers which contain supplies of perishable foodstuffs are transported seriatim past a station where they receive jets of preserving gas which expels air from the unfilled portions of containers, and the containers are then sealed by application of metallic or plastic foils which are bonded or otherwise sealingly secured to washer-like rims surrounding the open tops of the containers. The foils can be partially applied ahead of the gas introducing station and are thereupon finally sealed in at least one second step, particularly in a chamber wherein the containers advance stepwise downstream of the gas introducing station and wherein the temperature and/or pressure is maintained at a preselected value to promote expulsion of air from the containers prior to the final sealing step.

26 Claims, 3 Drawing Sheets

METHOD OF PRESERVING FOODSTUFFS IN CUP-SHAPED CONTAINERS

This application is a continuation of application Ser. No. 074,757, filed July 17, 1987, now abandoned.

CROSS-REFERENCE TO RELATED CASES

The apparatus of the present invention can be used in conjunction with on in lieu of apparatus which are disclosed in commonly owned copending patent application Ser. No. 767,410, filed Aug. 20, 1985, now U.S. Pat. No. 4,778,045, Ser. No. 801,796 filed Nov. 26, 1985, now U.S. Pat. No. 4,842,026, and Ser. No. 038,395 filed Apr. 13, 1987, now U.S. Pat. No. 4,867,351.

BACKGROUND OF THE INVENTION

The present invention relates to improvements in methods of and in apparatus for preserving goods which are confined in containers, particularly to improvements in methods of and in apparatus for preserving foodstuffs which are confined in substantially cup-shaped containers.

It is known to confine foodstuffs (e.g., salads or edibles which contain milk) in containers wherein the open top of the container is surrounded by a rim and the open top is sealed by a closure in the form of a metallic or plastic foil which is bonded to or is otherwise sealingly affixed to the rim. The storage life of foodstuffs in such containers depends on the extent to which the containers are filled, i.e., on the quantity of air which is entrapped in the sealed containers. In accordance with a presently known proposal, sealing of containers which contain metered or randomly selected quantities of perishable goods (such as foodstuffs) takes place in rooms wherein the composition of gases is selected, monitored and regulated with a view to ensure that the sealed containers will contain minimal quantities of oxygen. A drawback of such proposal is that the sealing of containers is a very expensive operation, mainly (or to a considerable extent) because the freshly filled containers entrain certain quantities of air into the room where the sealing operation takes place and, therefore, it is necessary to continuously withdraw air from the room and replace the withdrawn air with an inert gas which is not likely to adversely affect the storage life of the confined goods.

The situation is analogous if the containers which have received selected quantities of perishable goods are sealed in vacuo, i.e., such mode of evacuating air from containers is just as expensive as the establishment of a large room which accommodates the entire sealing apparatus and contains an inert gas or a mixture of inert gases at a predetermined temperature and pressure.

In accordance with a further prior proposal, perishable goods in cup-shaped or like containers are mixed with a medium which expels air from the containers not later than at the sealing station. A serious drawback of such proposal is that the medium which is admixed to perishable goods affects the quality and/or other desirable characteristics (such as the appearance) of goods in the containers. For example, the medium which is to expel air often causes foaming which changes the appearance of confined goods and renders them less palatable to consumers. Moreover, many types of perishable goods are likely to react with the admixed air expelling medium or media, and the condition of many perishable goods is likely to be changed solely as a result of mixing irrespective of the composition and/or nature of the medium or media which are to expel air. Still further, mixing of perishable goods with an air expelling medium will not always ensure adequate expulsion of air, even if one disregards the drawbacks of such procedure as concerns the appearance and/or quality of goods. Still further, mixing of goods with air expelling substances necessitates a substantial increase of bulk of container sealing apparatus. Last but not least, all heretofore known procedures exhibit the drawback that the percentage of air in confined goods is reduced (normally to about ten percent of the original volume) but not sufficiently to guarantee a relatively long storage life, for example, as known in connection with the canning of sardines and like foods in metallic containers which contain perishable foodstuffs and oil or another flowable substance which completely fills the sealed cans.

OBJECTS AND SUMMARY OF THE INVENTION

An object of the invention is to provide a novel and improved method of prolonging the storage life of perishable goods which are stored and sealed in cup-shaped or like containers.

Another object of the invention is to provide a method which renders it possible to prolong the storage life of perishable foodstuffs and other goods without the need to seal the containers in evacuated rooms or in rooms wherein the composition and/or other parameters of gases must be monitored and regulated with a high degree of accuracy and at a substantial cost.

A further object of the invention is to provide a method which renders it possible to completely expel air from containers prior to sealing or to expel all but negligible traces of air so as to ensure a substantial lengthening of storage life of the confined perishable goods.

An additional object of the invention is to provide a method which ensures predictable expulsion or all, or the major percentage of, air without affecting the appearance and/or the quality of confined goods.

Still another object of the invention is to provide a method which can be practiced in connection with confinement of a wide variety of goods including foodstuffs and many others and which can employ readily available air-expelling or displacing substances.

A further object of the invention is to provide a novel and improved apparatus for the practice of the above outlined method and to construct and assemble the apparatus in such a way that it can accept and manipulate simple and inexpensive mass-produced containers and closures therefor.

Another object of the invention is to provide the apparatus with novel and improved means for expelling air from filled or partially filled containers in a simple time- and space-saving operation.

An additional object of the invention is to provide the apparatus with novel and improved means for applying closures to cup-shaped and like containers which contain perishable goods.

Another object of the invention is to provide the apparatus with novel and improved means for multi-stage sealing of containers and with novel and improved means for multi-stage evacuation of air from the containers.

An additional object of the invention is to provide sealed containers which are treated in accordance with the above outlined method and in the above outlined apparatus.

A further object of the invention is to provide the apparatus with novel and improved means for pumping and/or otherwise admitting a gaseous preserving agent into containers which contain metered quantities of perishable goods including salads, milk-containing foodstuffs, industrial greases and/or others.

Another object of the invention is to provide the apparatus with novel and improved means for transporting containers past filling, air expelling, sealing and other devices.

One feature of the present invention resides in the provision of a method of preserving goods which are stored in substantially cup-shaped containers having open tops and preferably also having rims surrounding the open tops and which are sealable in such containers by closures which are caused to overlie the open tops, particularly of preserving foodstuffs which are perishable as a result of prolonged contact with air. The method comprises the steps of introducing into the containers a preserving gas by way of the open tops of the respective containers so that the introduced gas expels air from those portions (if any) of the containers which are not filled with goods, and sealingly connecting the containers with the respective closures. The method can further comprise the step of transporting the containers (particularly in the form of a file or row) seriatim along a predetermined path having a first portion in which the preserving gas is introduced into successive containers and a second portion in which the containers are sealingly connected with the respective closures. The introducing step can be carried out in one or more stages, and the method can further include the step of admitting goods into the containers in a single stage or in two or more successive stages or steps.

The introduced gas can have a tendency to expand in the containers and to thus expel air from those portions of the containers which are not filled with goods. The preserving gas can be introduced in liquefied form, and such gas can exhibit little or no tendency to react with the goods, with the containers and/or with the closures. If the goods are edible, the preserving gas is preferably inert to foodstuffs. The preserving gas can be maintained at a temperature below that of the surrounding atmosphere, at least in the course of the introducing step. In accordance with certain presently preferred embodiments of the method, the preserving gas contains or consists of nitrogen, a noble gas or carbon dioxide, or such gas is a mixture of two or more gaseous components.

The closure can contain at least one foil which can contain or can be made of a metallic or plastic material and is preferably fluidtight.

The connecting step can include securing the closures to the rims of the respective containers, and this can involve bonding (such as welding), adhesively securing the closures to the rims or mechanically securing the closures to the rims of the respective containers (e.g., by fluidtightly wrapping metallic or plastic closures around the rims).

The connecting step can be carried out in two or more stages, and the first stage of such composite connecting step can include partial attachment of closures to the respective containers prior to or following the introducing step. Such partial attachment can include sealingly securing the closures to portions of the respective rims. The first stage can further include the establishment of paths for communication of the interior of the containers with the surrounding atmosphere. If the first stage of the connecting step precedes the introducing step, at least one second stage of such composite connecting step includes further (final) attachment of closures to the respective containers upon completion of the introducing step. The introducing step can include placing a conduit (e.g., a conduit in the form of an elongated substantially horizontal rail) between the rim of a container and the respective closure not later than upon completion of the first stage, and admitting the preserving gas into the container by way of such conduit.

The transporting step can include conveying the containers through a chamber (e.g., through a tunnel-shaped structure) upon completion of the introducing step and maintaining the pressure in the chamber at a value at which at least some of the introduced preserving gas is caused to leave the respective container until the pressure in the container drops to a preselected value (e.g., to or even below atmospheric pressure). The just described method can further include the step of subdividing the chamber into a series of compartments, and the transporting step then includes conveying the containers through successive compartments of the chamber. Furthermore, such method can include the step of admitting into the chamber a gas which may but need not be the same as the gas which is caused to enter the containers in the course of the introducing step. The just described method can further comprise the step of heating a portion of or the entire chamber, and/or the step of monitoring at least one parameter (e.g., the pressure) of gas in the chamber.

The method can further include the step of establishing in the containers a pressure which equals or approximates atmospheric pressure, at least in the course of the connecting step, particularly during the final stage of a multi-stage connecting step.

The transporting step can include advancing a file or row of containers in stepwise fashion so that intervals of transport alternate with intervals of dwell and that, during each interval of dwell, each next-following container occupies the position previously occupied by the immediately preceding container. This renders it possible to employ stationary gas introducing and connecting means, i.e., means which need not move in the direction of advancement of containers along their path.

Another feature of the invention resides in the provision of an apparatus for preserving goods which are stored in substantially cup-shaped containers having open tops with preferably washer-like rims surrounding the open tops and being sealable by closures (e.g., in the form of metallic or plastic foils) which (when properly applied) overlie the open tops of the containers and the goods in such containers. The apparatus can be used with particular advantage for the preservation of salads, milk-containing foods and other types of edible substances which are perishable as a result of prolonged contact with atmospheric air. The improved apparatus comprises means for introducing into containers a preserving gas (such as a noble gas, nitrogen, carbon dioxide or a mixture of two or more gases) by way of the open tops of the respective containers so that the introduced gas expels air from those portions of containers which are not filled with goods, and means for sealingly connecting the closures with the respective containers.

The introducing means can include a vessel for a supply of preserving gas (which can be in a gaseous or in a liquid aggregate state), and conduit means connected with the vessel and having outlet means for admission of preserving gas into containers from above. Such apparatus preferably further comprises means for metering the quantities of preserving gas which is admitted into containers by way of the conduit means. The metering means can include adjustable valve means in the conduit means and means (e.g., a solenoid) for adjusting the valve means.

The apparatus preferably further comprises means for transporting a series of successive containers in a predetermined direction along a predetermined path (preferably along a substantially horizontal path) past the introducing and connecting means, and such transporting means is preferably provided with sockets for discrete containers. The containers are preferably received in their sockets in such a way that the open tops face upwardly. The transporting means can include an apron conveyor having a series of substantially plate-like links which are provided with the aforementioned sockets, and the conveyor preferably includes a substantially horizontal upper reach which is located beneath the introducing and connecting means. The conveyor can further comprise means for articulately coupling neighboring links to each other for relative movement about axes which extend substantially at right angles to the predetermined direction. The conveyor can further comprise one or more endless chains or belts or one or more belts or chains of finite length which are connected with the coupling means and are disposed in one or more planes extending substantially at right angles to the aforementioned reach. If the conveyor includes one or more chains, it further comprises one or more sprocket wheels for the chain or chains; such sprocket wheel or wheels are rotatable about axes extending substantially at right angles to the predetermined direction. The links are preferably provided with annular recesses which surround the respective sockets and serve to receive the rims of containers in the respective sockets. The conveyor can further comprise sealing elements which are interposed between successive links of the series of links and extend substantially transversely of the direction of advancement of containers with the links. The sealing elements can serve to prevent uncontrolled escape of preserving gas into the surrounding atmosphere and/or to prevent penetration of atmospheric air into the region above the upper reach of the conveyor if such region is to be sealed from atmosphere, e.g., by an elongated chamber which will be described hereinafter.

The apparatus can further comprise means for admitting goods into the containers in the sockets of the conveyor. Such admitting means is located ahead of the introducing and connecting means as seen in the predetermined direction. The admitting means can include a source of goods and conduit means connected to the source and having outlet means arranged to admit goods through the open tops of the containers in or on the conveyor. The admitting means can further comprise means for metering the quantities of goods which are admitted into the containers by way of the conduit means; such metering means can comprise adjustable valve means in the conduit means and means (e.g., solenoid means) for adjusting the valve means. The admitting means can be omitted or deactivated if the containers are already filled at the time they enter the sockets of the conveyor.

The apparatus can further comprise means for supplying closures to successive containers in a predetermined portion of the path. Such supplying means can be located downstream of the introducing means. The connecting means can include a first unit which has means for sealingly applying closures to portions of the rims of the respective containers prior to introduction of preserving gas, and a second unit for completion of the application of closures to the respective rims upon completion of introduction of preserving gas into the corresponding containers. The first unit can be designed to apply closures in such a way that each rim and the respective closure define a passage for the establishment of communication between the interior of the respective container and the surrounding atmosphere. The arrangement may be such that the passages extend along 1–10% of the respective rims as seen in the circumferential direction of the corresponding containers. The means for supplying closures to containers is adjacent the predetermined path upstream of the first unit of the connecting means. The first unit of the connecting means can include an applicator (e.g., a reciprocable ram) and means for moving the applicator up and down adjacent a predetermined portion of the path. The applicator can be provided with a closure-engaging surface which faces the open top of the container in the adjacent portion of the path and has a preferably eccentrically located recess or depression surrounded in part by a substantially plane annular portion of the surface. The path is preferably horizontal, the same as the surface of the applicator, and such surface is located at a level above the path. The means for supplying closures can be located upstream or downstream of the introducing means. If the supplying means is located upstream of the introducing means, the first unit of the connecting means is preferably located between the supplying means and the introducing means, and at least one second unit is located downstream of the introducing means and carries out the aforementioned step of sealing the passages which connect the interior of successive containers with the surrounding atmosphere. The second unit of the connecting means can include a substantially ram-shaped applicator or closing element and means (e.g., a fluid-operated cylinder and piston aggregate) for moving the closing element with reference to a container in the adjacent portion of the predetermined path. The moving means is or can be designed to move the closing element up and down.

The introducing means can include a conduit (e.g., in the form of an elongated rail which is adjacent the path of movement of containers and extends in the predetermined direction) which serves to prevent complete sealing of the open top of an adjacent container by the first unit of the connecting means. The conduit can be provided with a hole or bore which extends substantially transversely of the predetermined direction and serves to admit preserving gas into the adjacent container by way of the open top of the container. The hole has a discharge end in or immediately or closely above the adjacent container, and a gas receiving end which is remote from the container. The introducing means can comprise the aforementioned vessel for a supply of preserving gas and a second conduit which connects the vessel with the receiving end of the hold in the conduit extending in parallelism with the path of movement of containers with the conveyor. The conduit which extends in parallelism with the path can have a rounded portion which is in contact with the underside of at least one partially attached closure.

The apparatus can further comprise a chamber (e.g., in the form of an elongated tunnel or channel) which is adjacent the predetermined path downstream of the introducing means. The first unit of the connecting means is located upstream of the chamber to provide the aforementioned passages which enable the interior of each container to communicate with the interior of the chamber during each interval of dwell of a container in the chamber. This ensures that the gas which is introduced into a container upstream of the channel can escape by way of the respective passage during the interval of dwell of such container in the chamber. By the same token, gas which fills the chamber can penetrate into a container by way of the respective passage. The chamber preferably extends in the predetermined direction and is preferably long enough to simultaneously accommodate portions of two or more successive containers of a series or file or row of containers in the sockets of the conveyor. Sealing means (e.g., in the form of elastomeric sealing elements) can be interposed between the chamber and the transporting means.

The apparatus can further comprise means for subdividing the chamber into a series of two or more compartments each of which can accommodate a portion of at least one container, and the apparatus can also comprise means for monitoring and/or influencing the gas in one or more compartments. Each subdividing means can include at least one partition in the form of a flap which is movably mounted in the chamber and extends substantially transversely of the predetermined direction. For example, each partition can be connected to a roof portion of the chamber by one or more hinges for pivotal movement about a substantially horizontal axis which extends substantially transversely of the predetermined direction.

The apparatus can comprise means for heating at least a portion of the chamber, e.g., one of the compartments, and means for monitoring the temperature in the one compartment of the chamber. The arrangement may be such that the chamber can be provided with adjustable heating means and the means for monitoring the temperature can include a signal-generating thermometer or the like. The apparatus then further comprises means for adjusting the heating means in response to signals from the thermometer. Means can be provided for monitoring the pressure in the chamber and/or for monitoring the composition of the gas in the chamber (the gas which is used to expel air from the containers can contain a mixture of two or more gases which are insert to foodstuffs, to the containers, to the closures and/or to the goods which are confined in the containers as well as to the containers and closures). One or more conduits can be provided to admit gas into the chamber (such gas may but need not be identical with the gas which is supplied by the introducing means), and means can be provided to regulate the pressure in the chamber. If the gas in the chamber is a mixture of two or more gases, the apparatus can comprise means for regulating the composition of the mixture in the chamber.

At least one second unit of the connecting means can be installed in the chamber (e.g., in the last of a series of two or more successive compartments of the chamber), and such second unit comprises means for sealing the aforementioned passages between successive containers and the respective closures. The second unit can comprise the aforementioned closing element and means for moving the closing element up and down away from and toward the closures for successive containers in the predetermined path.

The apparatus can further include suitable turbulence reducing or preventing means in the form of streamlined vanes or blades which are provided in the chamber adjacent the second unit to prevent the development of turbulence in the chamber during sealing of the passages. Such turbulence reducing or preventing means can be made of or can contain Teflon (trademark).

The transporting means is preferably designed to convey a single file or two or more files of successive containers in stepwise fashion so that each next-following container occupies the position preferably occupied by the preceding container whenever the containers come to rest.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
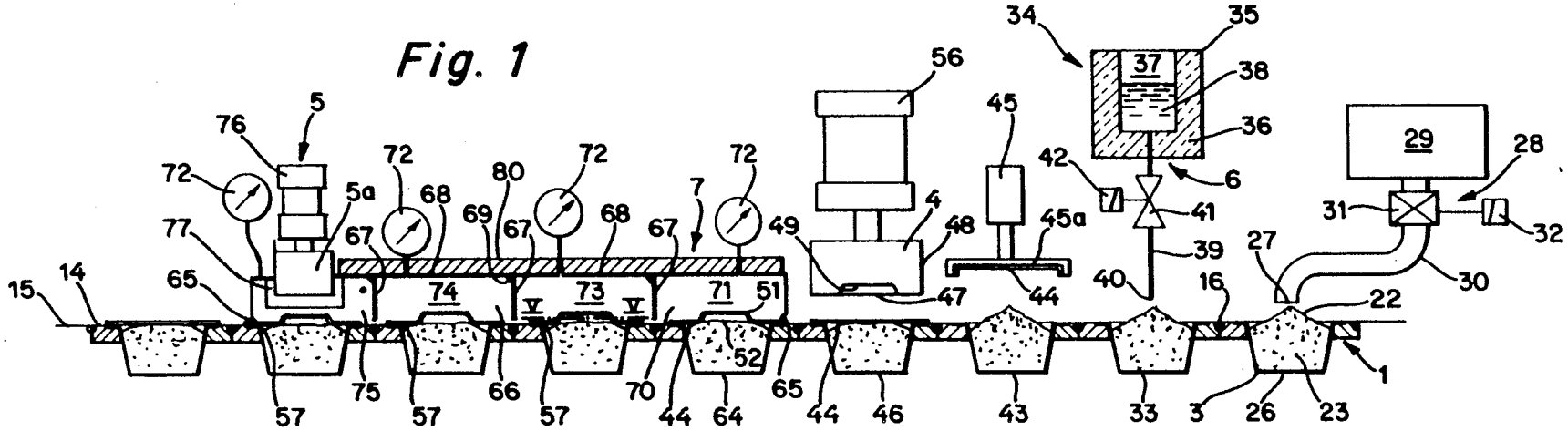
FIG. 1 is a schematic partly elevational and partly vertical sectional view of an apparatus which embodies one form of the invention and wherein the multi-stage application of closures to successive containers takes place downstream of the gas introducing station.
Figure 2:
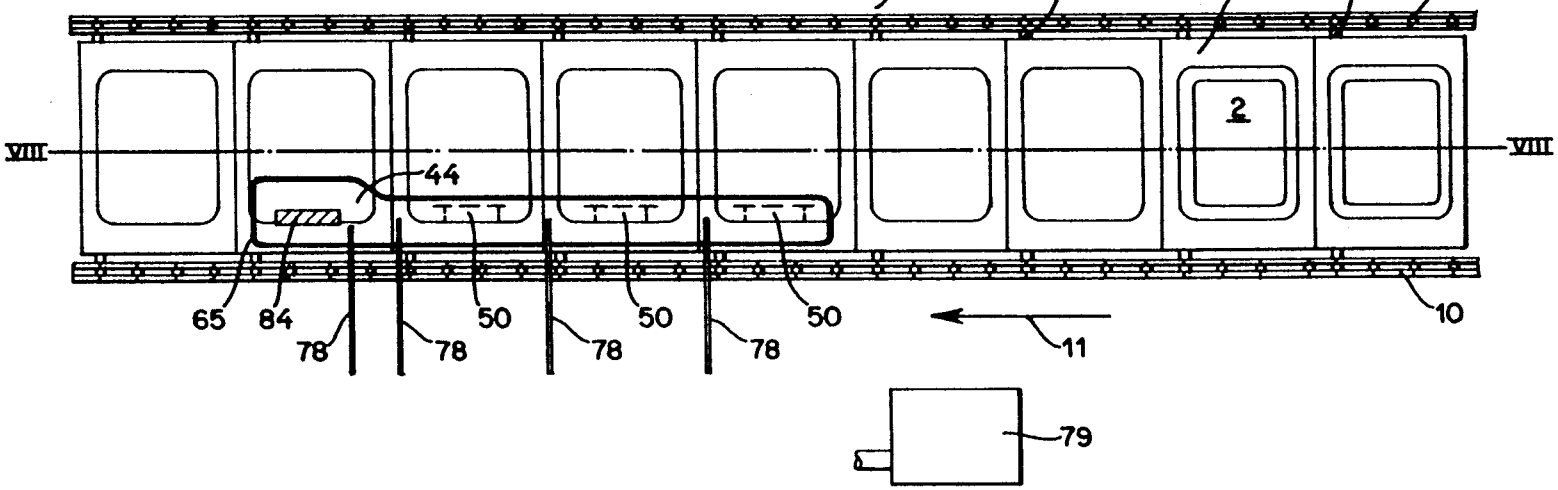
FIG. 2 is a schematic plan view of a portion of the apparatus of FIG. 1.

The apparatus which is shown in FIGS. 1 and 2 comprises a transporting system 1 which has a file or row of sockets 2 for discrete cup-shaped containers 3. The transporting system 1 defines an elongated horizontal path along which the containers 3 in their sockets 2 are advanced in the direction of arrow 11 past a gas introducing device 6 and a composite sealing or closure connecting device including a first unit 4 and a second unit 5 both located downstream of the introducing device 6. The apparatus further comprises a chamber 7 in the form of an elongated horizontal tunnel which is mounted downstream of the first unit 4 of the composite connecting device and accommodates certain parts of the second unit 5.

Figure 8:
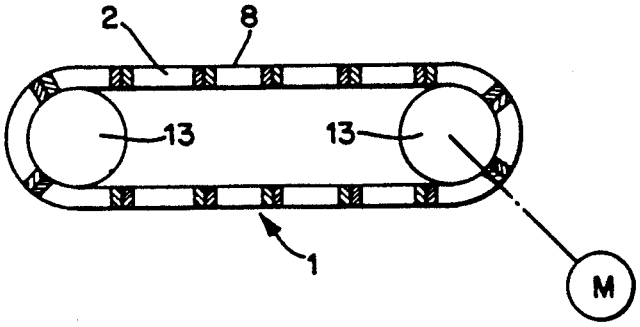
FIG. 8 is a schematic smaller-scale elevational view of a portion of the means for transporting containers past the gas introducing and other stations, the view being taken from the line VIII—VIII in FIG. 2.

The transporting system 1 includes an apron conveyor (see also FIG. 8) having an endless series of substantially plate-like links 8 flanked by two endless chains 10. Each link 8 is coupled to both chains 10 by horizontal pins 9 whose axes 12 are horizontal and extend at right angles to the direction (arrow 11) of advancement of containers 3 with the links 8. Each link 8 has a centrally located socket 2 in the form of a square or rectangular hole for a discrete container 3. The chains 10 are located in two vertical planes extending in the direction of arrow 11 at right angles to the common horizontal plane of those links 8 which together constitute the upper reach of the apron conveyor. Each chain 10 is trained over two sprocket wheels 13 which are rotatable about horizontal axes extending at right angles to the direction of advancement of containers 3 with the respective links 8. At least one sprocket wheel 13 for at least one of the chains 10 is driven by a stepping motor M or a like prime mover which can advance the links 8 in stepwise fashion through increments of predetermined length so that each interval of advancement in the direction of arrow 11 is followed by an interval of dwell long enough to allow for completion of the longest operation which must take place at one of several stations adjacent the path of the upper reach of the apron conveyor. The extent of stepwise advancement of the apron conveyor is such that each next-following container 3 comes to rest in a position previously occupied by the immediately preceding container of the file of containers carried by the transporting system 1. The links 8 are provided with pairs of parallel ledges 14 which extend upwardly from the common horizontal plane 15 of such links and are adjacent the respective chains 10 to reduce the likelihood of contamination of chains by the goods 23 in the containers 3 within the respective sockets 2.

Figure 7:
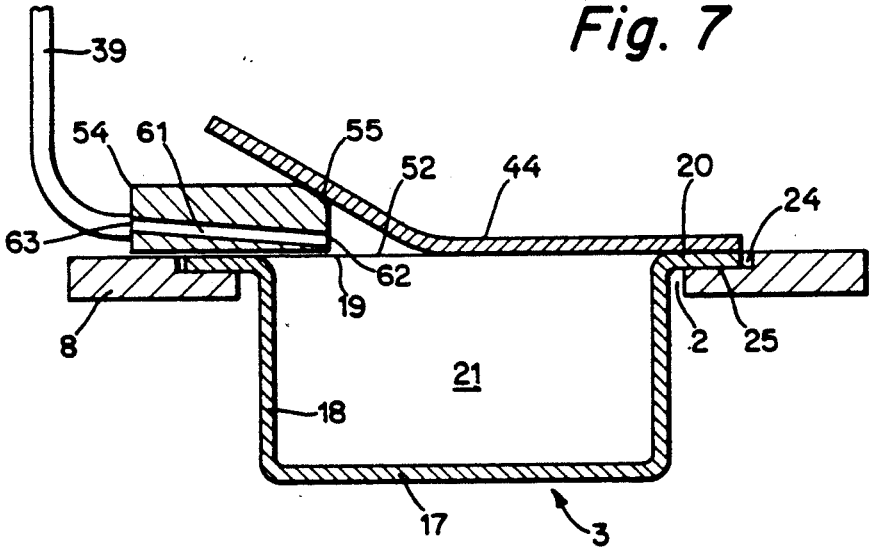
FIG. 7 is an enlarged sectional view of a portion of the conveyor and of a container with the closure partially connected to the rim and with a rail-shaped conduit in the process of admitting preserving gas into the unfilled portion of the container.

The apron conveyor of the transporting system 1 further comprises sealing elements 16 which are interposed between neighboring links 8 and extend transversely of the direction which is indicated by the arrow 1. Each sealing element 16 can consist of an elastomeric material and can resemble or constitute an elongated bead, strip, rod or cylinder which is installed in the plane 15 of the links 8 and serves to prevent contamination of the area beneath the upper reach of the apron conveyor by foodstuffs or by other goods which might have overflown the open tops 22 of the respective containers 3. Each such container further comprises a frame-like or washer-like rim 20 (see particularly FIG. 7) which is received in a complementary annular recess or depression 24 in the upper side of the respective link 8. The depth of the recess 24 is or can be such that the upper sides of the rims 20 are flush with the upper sides of the respective links 8. FIG. 7 further shows that each cup-shaped container 3 comprises a bottom wall 17 and a tubular sidewall 18 which connects the marginal portion of the bottom wall 17 with the innermost portion 19 of the respective rim 20. The internal space or interior 21 of each container 3 which reaches the gas introducing device 6 is at least partially filled with goods 23, e.g., with a milk-containing solid or liquid food, a salad or any other edible substance which is likely to be adversely affected by prolonged contact with air. The rim 20 is preferably flat and its rigidity suffices to ensure that the container 3 is adequately retained in the respective socket 2 even if such container is filled or practically filled with perishable goods which must be preserved by the application of closures 44 in the form of metallic or plastic foils or the like. In other words, the rim 20 of a container 3 should not flex in the region of its innermost portion 19 when the rim is received in and substantially fills the respective recess 24. The underside 25 of the rim should preferably lie flat against the surface at the bottom of the respective recess 24. The entire container 3 can be made of a single piece of suitable plastic material. Each rim 20 surrounds the open top 22 of the respective container 3. It is clear that the apparatus of the present invention can also treat and seal containers having a circular, oval or any other suitable outline.

The apparatus further comprises a device 28 which is located at an admitting station 26 and serves to admit metered quantities of goods 23 into successive empty containers 3. Such empty containers are introduced into the sockets 2 of successive links 8 at a further station (not shown) upstream of the admitting station 26. The device 28 comprises a source 29 of goods 23, a conduit 30 which is connected to an outlet of the source 29 and has an outlet 27 at a level above the path of open tops 22 of empty containers 3 in the apron conveyor of the transporting system 1. The means for admitting metered quantities of goods 23 into successive containers 3 includes an adjustable valve 31 in the conduit 30 and a solenoid 32 or other means for adjusting the valve 31 so that the latter remains open for a preselected interval of time while an empty container 3 dwells at the station 26. Metered quantities of goods 23 can be admitted by gravity flow and/or with assistance from a compressed gaseous fluid and/or with assistance from mechanical advancing means, not shown. For example, the pressure in the source 29 can be maintained at a preselected level so that a predetermined quantity of material leaves the source 29 in response to opening of the valve 31 for a predetermined interval of time. As mentioned above, the goods 23 which are admitted into successive empty containers 3 can constitute edible substances (such as salads, milk-containing beverages or milk-containing foods of pasty or like consistency, precooked foods such as tv-dinners and the like). However, it is equally possible to utilize the improved apparatus for admission of metered quantities of other types of goods such as small mechanical parts which must be shielded from the atmosphere, as well as greases, lubricants and other viscous or like materials for use in various industries.

The gas introducing device 6 is located downstream of the station 23 at a station 33 where successive containers 3 come to a halt during successive intervals of dwell of the transporting system 1 and where each such container already contains a metered quantity of goods 23. The gas introducing device 6 includes a vessel 34 whose housing 35 includes an insulating jacket 36 and defines a chamber 37 for a supply of preserving gas 38. The device 6 further comprises a conduit 39 which is connected with the vessel 34 and has an outlet 40 at a level above the open top of the container 3 occupying the station 33. The means for admitting metered quantities of preserving gas 38 into the container 3 at the station 33 includes a valve 41 which is installed in the conduit 39 and is adjustable by a solenoid 42 or by other suitable adjusting means in a manner not forming part of the present invention. It suffices to say that the device 6 can introduce into each filled container 3 a quantity of preserving gas 38 (which can be in a gasiform or in a liquefied state) sufficing to ensure that the gas expels some or all of the air from that portion 57 of a container which is not filled with goods 23. The conduit 39 can constitute a rigid pipe or a flexible hose, or it can include rigid as well as flexible portions. The outlet 40 of this conduit can be located immediately above or close to the open top 22 of the container 3 at the station 33. It is presently preferred to store the preserving gas 38 in a liquid state because this ensures a more reliable filling of the portion 57 of internal space 21 of each container 3 at the station 33 with a medium which thereupon expands and expels air from the unfilled portion of such container.

The gas introducing device 6 is followed by a device 45, 45*a* which is located at a station 43 and constitutes a means for supplying discrete closures 44 to containers 3 which reach the station 43. The supplying device 45, 45*a* are preferably such that the closure which is applied to the container 3 at the station 43 overlies the entire rim 20 of the container and can even extend laterally beyond the rim if the closure is to be brought into sealing engagement with the rim by purely mechanical means so that it is desirable or even necessary to fold the marginal portion of the closure beneath the underside 25 of the respective rim. The device 45, 45*a* can comprise a panel 45*a* or a similar applicator at the lower end of the piston rod of a hydraulically or pneumatically operated cylinder and piston unit 45 serving to move the applicator 45*a* downwardly when the transporting system 1 comes to a halt and a fresh container 3 with a supply of goods 23 therein dwells at the station 43.

The station 43 is followed by a station 46 for the first unit 4 of the device which sealingly connects the closures 44 to the respective containers 3. The unit 4 comprises a vertically reciprocable closing element or ram 48 having a flat horizontal bottom surface 47 which confronts the station 46 and has an eccentrically located depression or recess 49 which is partially surrounded by the adjacent (flat) portion of the surface 47. The closing element 48 is movable up and down by a motor 56 which can constitute a pneumatically or hydraulically operated cylinder and piston unit. The closing element 48 can contain suction generating means to draw the material of the closure 44 at the station 46 into the recess 49 so that the closure and the rim 20 of the respective container 3 define a relatively small passage 50 serving to establish a path for communication of the internal space 21 of the container with the surrounding atmosphere. Alternatively, the material of the closure 44 and the deforming action of the closing element 48 can be selected in such a way that the closure 44 is compelled to define with the adjacent rim 20 a passage 50 for the escape of preserving gas which is admitted at the station 33. The closing element 48 can further include means for heating selected portions of the closure 44 at the station 46 so that such selected portions are sealingly secured to the adjacent portions of the rim 20 at the station 46 in response to downward movement of the element 48. The deformed closure 44 develops a dome 51 which is located at a level above the level 52 of the respective rim 20; this can be seen in FIG. 1.

The station 46 is followed by the elongated chamber 7 which overlies several successive links 8 of the transporting system 1 and resembles an elongated narrow tunnel overlying the passages 50 of the containers 3 below it. As shown in FIG. 2, the chamber 7 overlies four successive containers 3 during each interval of dwell of the transporting system 1. This chamber is horizontal and extends in the direction which is indicated by the arrow 11. The rearmost container 3 which is overlapped by the chamber 7 when the apron conveyor including the links 8 is at a standstill is located at a station 64 which follows the station 46. The roof portion 68 of the chamber or tunnel 7 carries three preferably equidistant partitions 67 which constitute a means for subdividing the interior 66 of the chamber 7 into a series of four compartments 71, 73, 74 and 75. Such compartments are located immediately above the plane 15 of the links 8 which constitute the upper reach of the apron conveyor, and the chamber 7 is provided with sealing elements 65 in the form of elastic bars, strips, ribs or beads which seal the compartments 71, 73, 74 and 75 from the surrounding atmosphere but enable the compartments to communicate with the passages 50 of the respective containers 3. The material of the sealing elements 65 can be rubber or a synthetic plastic material exhibiting similar elastic properties. The reference character 69 denotes in FIG. 1 one of the hinges which serve to pivotally connect the partitions 67 to the roof portion 68 and define horizontal pivot axes extending at right angles to the direction which is indicated by the arrow 11. The partitions 67 can be pivoted by the domes 51 of successive deformed closures 44 when the apron conveyor of the transporting system 1 is in motion.

The internal space 70 of the rearmost compartment 71 allows for expansion of the preserving gas which issues from the respective container 3 by way of the corresponding passage 50. The composition of the gas which fills or partially fills the space 70 in the compartment 71 is monitored by a suitable measuring instrument 72 which can further include a pressure gauge. The measuring instrument 72 can constitute a composite instrument having several components each of which can monitor the quantity of one of several gases if the internal space 70 contains a mixture of two or more gases, for example a mixture of air and preserving gas of the type stored in the vessel 34. It also suffices to employ a monitoring instrument which can ascertain the presence or absence and the quantity of oxygen in the space 70. Such instruments are well known and are available on the market.

Expansion of preserving gas continues in the second and third compartments 73 and 74 of the chamber 7. Each of these compartments is also connected with one or more measuring or monitoring instruments 72, and at least one additional instrument 72 is provided to monitor the pressure, temperature and/or other parameters of the gas or gases in the last compartment 75 which receives a portion of the second unit 5 of the device which connects the closures 44 to the rims 20 of the respective containers 3. The unit 5 includes a closing element or ram 5*a* which is movable up and down by a hydraulically or pneumatically actuated cylinder and piston unit 76 and can be provided with heating means so as to close the passage 50 of the container 3 below the compartment 75 and to thus complete the sealing operation involving the connection of a closure 44 to the respective rim 20. The compartment 75 preferably further accommodates an insert 77 in the form of one or more vanes or otherwise configurated parts which reduce or eliminate turbulence in the compartment 75, at least in the course of the sealing operation by the ram 5*a* of the unit 5. The insert 77 can be made of, or it can be at least partially coated with, TEFLON (trademark).

At least one compartment of the chamber 7 is further connected with a source 79 (FIG. 2) of gaseous fluid. For example, each of the compartments 71, 73, 74 and 75 can be connected to the source 79 by a conduit 78. The gas in the source 79 can be identical with the gas 38 in the vessel 34 of the introducing device 6. The source 79 can be omitted if the conduits 78 are connected directly to and can receive gas from the vessel 34. Alternatively, the conduit 39 can receive gas from the source 79 (i.e., the vessel 34 can be omitted). The feature that at least one of the compartments in the chamber 7 can receive preserving gas further reduces the likelihood of premature spoilage of goods 23 in the sealed containers 3.

The apparatus can further comprise one or more heating means 80 for one or more compartments in the chamber 7. The heating means 80 can be installed in or on the cover portion 68 of the chamber 7 to heat the contents of one or more compartments and to thus promote expansion of preserving gas with attendant expulsion of air from the container 3 beneath the respective compartment. The apparatus can also comprise means (e.g., a thermometer or the like) for monitoring the temperature in the heated compartment or compartments and for generating signals which are used to adjust the heating means 80, if and when necessary.

The operation of the apparatus of FIGS. 1 and 2 is as follows:

The transporting system 1 is operated stepwise by the motor M to advance a series of empty containers 3 from the loading station (upstream of the station 26 in FIG. 1) to the station 26 where each empty container receives a metered quantity of goods 23 in the aforedescribed manner, i.e., in response to opening of the valve 31 for a preselected interval of time. The freshly filled container 3 is then advanced from the station 26 to the station 33 and comes to a halt not later than when the adjusting means 42 opens the valve 41 so as to admit a metered quantity of preferably liquefied preserving gas 38 which fills the portion 57 of the space 21 in the respective container. The thus admitted gas 38 begins to expand as soon as it leaves the outlet 40 of the conduit 39 in that it changes its aggregate state and thereby expels air from the interior of the respective container. The expanding gas 38 is normally selected to expel oxygen so as to prolong the storage life of goods 23 which, as a rule, are likely to spoil as a result of prolonged contact with oxygen.

The transporting system 1 thereupon advances the container 3 from the station 33 to the station 43 where the container is overlapped by a closure 44 in the form of a metallic or plastic foil which can be welded, adhesively secured or mechanically attached to the adjacent rim 20 following advancement of the container beyond the station 43. It goes without saying that the movements of all movable parts of the improved apparatus are or can be synchronized to a desired extent so that the apparatus can turn out a large number cf filled and properly sealed containers 3 per unit of time. Furthermore, the closures 44 need not necessarily consist of or contain a metallic or plastic material (such as foil). All that counts is to provide closures which can be placed into reliable sealing engagement with the rims 20 of the respective containers 3 in response to the application of heat, pressure, adhesive and/or in any other suitable way which does not affect the quality of the confined goods and does not unduly prolong the sealing operation.

Figure 5:
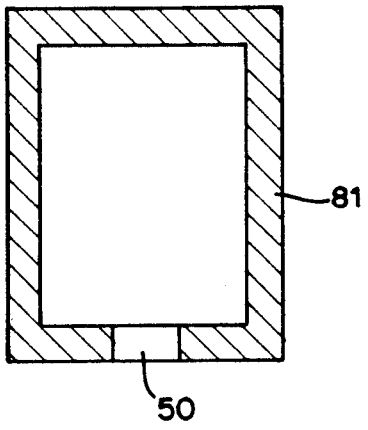
FIG. 5 is an enlarged horizontal sectional view taken along the line V—V in FIG. 1.
Figure 6:
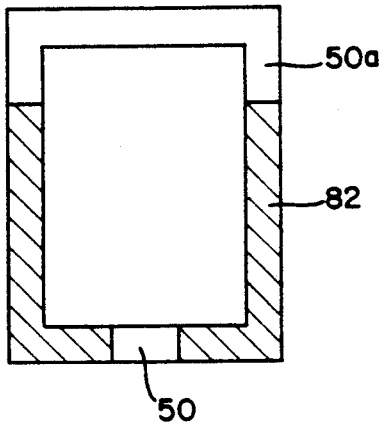
FIG. 6 is an enlarged horizontal sectional view taken along the line VI—VI in FIG. 3.

The container 3 which has been provided with a closure 44 then advances to the station 46 where the closure is acted upon by the closing element 48 so as to establish a partial seal between the closure and the adjacent trim 22 as well as to provide a passage 50. The passage 50 can be so small that it extends only along 1-10% of the periphery of the container 3, i.e., the major part of the closure 44 can be bonded or otherwise sealingly secured to the adjacent rim 20 during the interval of dwell of the respective container at the station 46 beneath the first unit 4 of the connecting device. FIG. 5 shows that the area 81 of sealing contact between a rim 20 and the respective closure 44 can extend practically all the way around the open top 22 of the container 3 save for a relatively narrow passage 50 which allows for expulsion of air from the container and for expansion of preserving gas not later than in the compartments of the chamber 7. FIG. 6 shows that the area 82 of sealing engagement between a closure 44 and the adjacent rim 20 can be much smaller and the rim and the closure can define several passages including a relatively small passage 50 (as in FIG. 5) and a much larger or longer passage 50*a*. This will be described with reference to FIGS. 3 and 4.

When the container 3 which already carries a partially affixed closure 44 reaches the first compartment 71 of the chamber 7, air is being expelled from its interior by way of the passage 50 due to expansion of preserving gas 38 which was admitted via conduit 39 at the station 33. Expulsion of air from such container continues in the compartments 73, 74 and also in the compartment 75 prior to actual sealing of the passage 50 by the ram 5*a* of the second unit 5 of the composite connecting device 4, 5. The arrangement is preferably such that the pressure in the interior of a container 3 in the compartment 75 equals or closely approximates atmospheric pressure not later than when the passage 50 is sealed by the unit 5. The evacuation of air from the non-occupied portion 57 (if any) of the container 3 in the compartment 75 is complete or nearly complete, i.e., the percentage of air in the freshly sealed container is or can be close to zero. Such complete or nearly complete evacuation of air is promoted by the expanding gas 38 which was admitted at the station 33 as well as by the gas which is supplied by the source 79 and enters the compartments 71, 73, 74, 75 by way of the respective conduits 78. Streams or jets of gas which are supplied by the conduits 78 serve to expel air from the respective compartments to thus allow for further expansion of preserving gas in the containers 3 and expulsion of additional air from the containers into the respective compartments. The pressure of the body of preserving gas in each of the compartments can be regulated individually, or the chamber 7 can be provided with means for jointly regulating the pressure in all or some of the compartments so as to enhance the expulsion of air from the containers which advance stepwise from the station 46 toward and into the compartment 75. Expulsion of atmospheric air from the compartments 71, 73, 74, 75 by streams or jets of preserving gas which are supplied by the conduits 78 is desirable and advantageous on the additional ground that this eliminates the possibility of penetration of air from the compartments into the containers therein, i.e., the possibility of flow of atmospheric air from the compartments, through the passages 50 and into the unoccupied or unfilled portions 57 of internal spaces 21 of the respective containers. The rate of expansion of preserving gas in the containers 3 and in the compartments of the chamber 7 is or can be regulated by appropriate adjustments of the heating means 80 in the roof portion 68 of the chamber 7 and/or by appropriate selection of the pressure in the compartment 71, 73, 74 and/or 75. The attachment of successive closures 44 to the respective rims 20 is completed by the unit 5 (note the seal 84 in FIG. 2 which closes the passage 50). Penetration of atmospheric air into the chamber 7 is prevented by appropriate selection of pressure in the compartments and/or by the aforementioned sealing elements 65.

Figure 3:
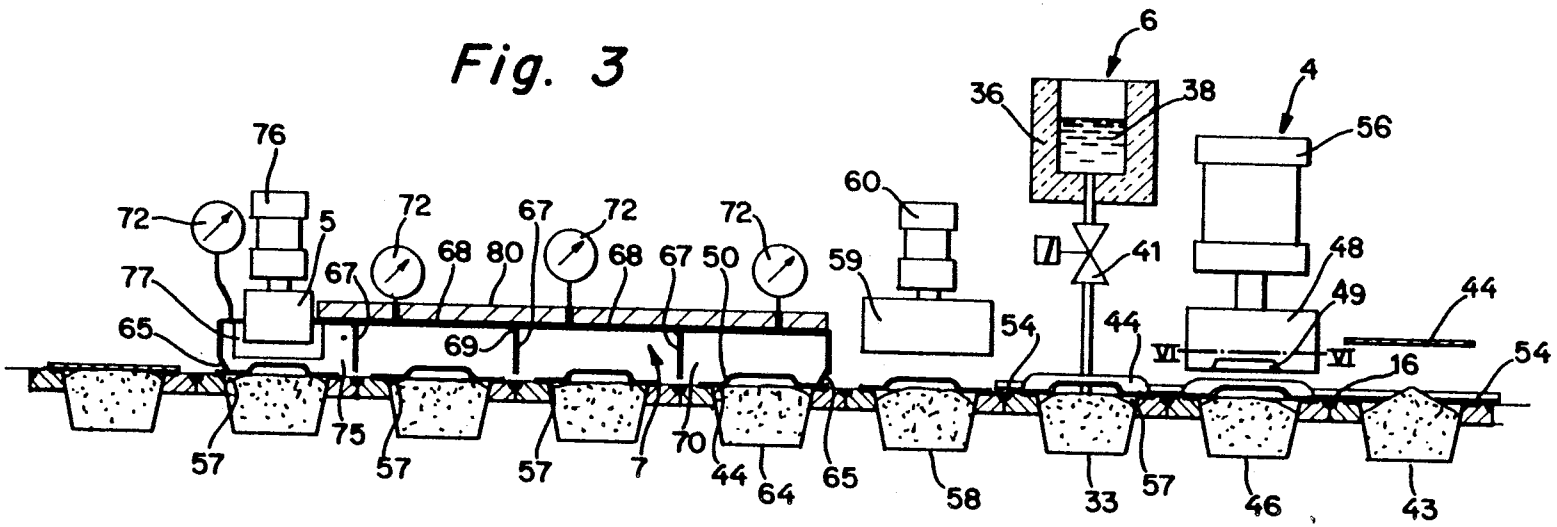
FIG. 3 is a partly elevational and partly vertical sectional view of a second apparatus wherein partial application of closures to successive containers takes place ahead of the gas introducing station.
Figure 4:
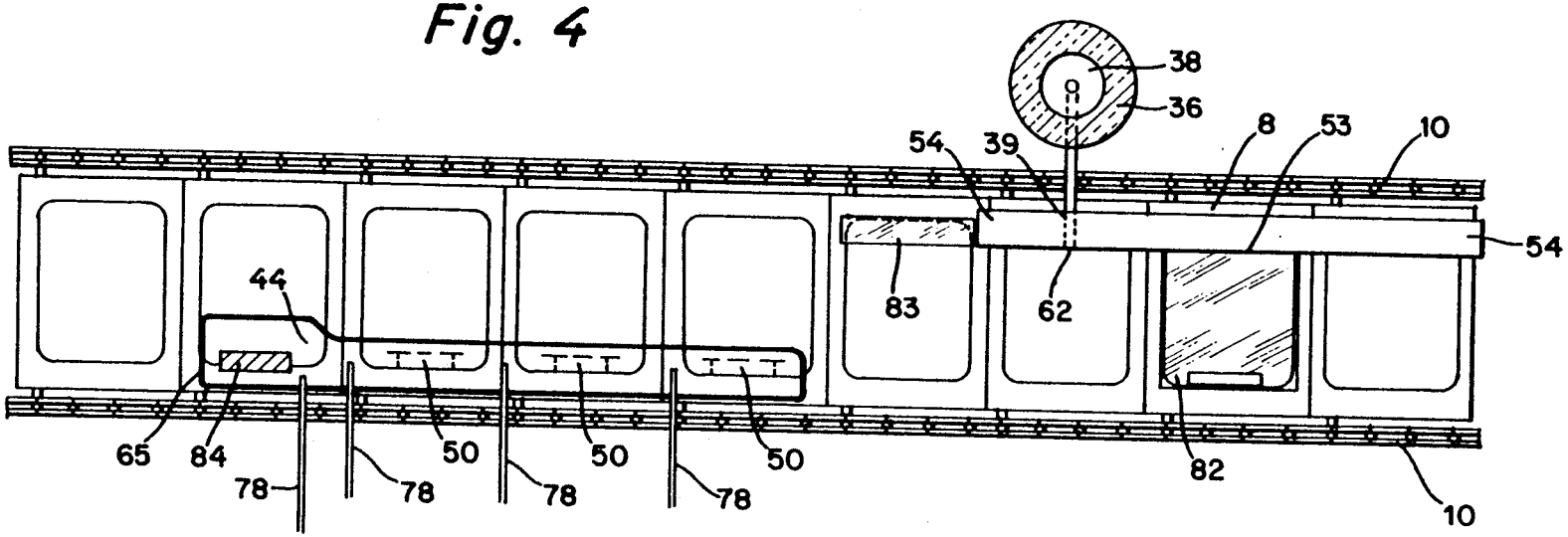
FIG. 4 is a plan view of a portion of the second apparatus.

FIGS. 3 and 4 show a modified apparatus wherein the device 28 (not shown) which supplies goods 23 into successive containers 3 is located upstream of the station 43 for the device which supplies closures 44 in the form of opaque, transparent or translucent metallic or plastic foils or the like. The station 43 is followed by the station 46 for the first unit 4 of the composite connecting device, and this station is followed by the station 33 for the gas introducing device including the parts 36, 41 as well as an elongated horizontal conduit 54 in the form of a rail which is parallel to the direction of stepwise advancement of the containers 3 with the transporting system and extends also along the stations 43 and 46. As can be seen in FIG. 4, the conduit or rail 54 prevents the closing element of the unit 4 from applying a closure 44 to the adjacent portion of the rim 22 (note the line 53 in FIG. 4) and the passage 50*a* in FIG. 6 so that the corresponding portion of the closure 44 remains lifted in a manner as shown in FIGS. 6 and 7. The conduit 54 has a rounded portion in the form of a longitudinally extending chamfered edge 55 (FIG. 7) which abuts the undersides of the adjacent closures 44 and offers little resistance to stepwise advances of the containers 3 along their path toward the chamber 7. It will be readily appreciated that the configuration of the closing element 48 of the unit 4 must conform to the configuration of the adjacent portion of the conduit 54, either by simply omitting the respective portion of the closing element 48 or by providing in the underside of the closing element 48 an appropriate recess which receives the adjacent portion of the conduit 54 when the motor 56 causes the closing element to descend in order to secure the closure 44 at the station 46 to predetermined portions 82 (see FIG. 6) of the rim 20 below it. The unit 4 further causes the formation of passages 50, for example, in the same way as described in connection with FIGS. 1 and 2. The passages 50 are located opposite those unsealed or unconnected portions 50*a* of the respective rims which are adjacent the conduits 54 (see FIG. 6). However, it is equally possible to form each passage 50 adjacent the conduit 54 so that the passage 50 forms part of the respective larger passage 50*a* at 53 and permits practically unobstructed flow of air and preserving gas from the interior of the respective container 3.

The conduit or rail 54 is immediately or closely adjacent the upper sides 52 of the rims 20 which are located at the stations 43, 46 and 33. The width cf the conduit 54 (as seen at right angles to the direction of advancement of containers 3 toward the chamber 7) suffices to ensure that the adjacent portions of the closures 44 cannot reach the respective rims 20 (as at 53 in FIG. 4). This conduit has a bore or hole 61 (FIG. 7) which extends or can extend substantially at right angles to the direction of advancement of containers 3 and has a receiving end 63 connected to the conduit 39 which receives preserving gas 38 from the vessel 34 of the device 6. The discharge end 62 of the hole or bore 61 extends into the space beneath the unconnected portion of the adjacent closure 44 so that it can discharge preserving gas into the interior of the respective container 3. The receiving end 63 of the hole or bore 61 is remote from the container 3 which is in the process of receiving a metered quantity of preserving gas from the device including the conduit 54.

The connecting device of the apparatus which is shown in FIGS. 3 and 4 comprises three units, namely the unit 4 at the station 46, the second unit 5 in the last compartment 75 of the chamber 7, and an intermediate or additional unit 59, 60 at a station 58 between the station 33 and the station 64 for the first compartment of the chamber 7. The closing element or ram 59 of the additional unit of the tripartite connecting device is reciprocable by a motor 60 and serves to seal successive closures 44 at 83 so as to eliminate the relatively large passages 50*a* which are formed as a result of the aforediscussed positioning of the conduit or rail 54 at the station 46. Thus, each closure 44 which enters the first compartment of the chamber 7 is or can be sealed to the respective rim 20 practically all the way around save for the passage 50 or a passage of similar size. The treatment of containers during travel beneath the chamber 7 of the apparatus of FIGS. 3 and 4 is or can be identical with the aforedescribed treatment of containers which advance beneath the chamber 7 of the apparatus of FIGS. 1 and 2.

An important advantage of the improved apparatus is its versatility. Thus, the apparatus can be used to prolong the storage life of a wide variety of goods and it is much less likely to affect the appearance, composition and/or other characteristics of the goods than heretofore known apparatus. This is due to the fact that the preserving gas which is admitted by the device 6 need not contact all of the goods but normally penetrates only into the unoccupied portion 57 of the internal space 21 of a container 3 so that the contact between the preserving gas and the goods is kept to a minimum.

Another important advantage of the improved apparatus is that the closures 44 are or can be partially applied to the rims 20 of the respective containers 3 prior to or immediately following the admission of metered quantities of a preserving gas. This renders it possible to use relatively small quantities of preserving gas as well as to further reduce the likelihood of renewed contact of perishable goods 23 with air upon admission of preserving gas at the station 33. The preserving gas which expands in and escapes from the partially sealed containers 3 (by way of the passages 50) constitutes a means for rinsing the interior of the respective containers by expelling residual quantities of air via passages 50 and into the atmosphere or into the chamber 7.

The chamber 7 is relatively small because it must communicate only with the relatively small passages 50 of a limited number of filled and partially sealed containers 3. This reduces the cost of maintaining the pressure, temperature and composition of the gas in the compartments 71, 73, 74 and 75 at or close to a predetermined value. Repeated expansion of preserving gas in the containers beneath the compartments 71, 73, 74 and 75 ensures that such expansion is completed not later than at the time of final sealing by the unit 5 so that the containers which leave the apparatus are not likely to explode or develop leaks (partial separation of closures 44 from the rims 20) as a result of continued expansion of preserving gases in their internal spaces. The pressure in a container which reaches the unit 5 can be determined in advance with a high degree of accuracy by properly controlling the quantity and pressure of preserving gas which is admitted by the device as well as by properly regulating the temperature, pressure and other parameters in the compartments of the chamber 7.

The improved method and apparatus are susceptible of many additional modifications without departing from the spirit of the invention. For example, the composition and/or other parameters of the preserving gas can be selected in dependency on the nature and desired storage life of the confined goods, and the device which connects the closures 44 to the rims 20 can be simplified or modified in a number of ways, as long as it can ensure reliable sealing of containers upon completion of the air expelling operation. The quantity of admitted preserving gas will depend on the dimensions of the containers 3, on the extent to which the containers are filled with perishable goods, on the desired degree of expulsion of oxygen and on the nature of treatment in the chamber 7, e.g., on the quantities of gaseous medium which are supplied via conduits 78.

It has been found that the improved method and apparatus can reduce the percentage of air in the sealed containers to zero or close to zero. It was also ascertained that the evacuation of air is especially pronounced if the apparatus employs the conduit 54 of FIGS. 3 and 4 and a three-unit connecting device including the units 4, 5 and the unit 59–60 at the station 58 of FIG. 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of preserving perishable goods which are stored in substantially cup-shaped containers having open tops and are sealable in said containers by closures overlying the open tops, comprising the steps of partially attaching the closures to the containers so as to establish at least one path for evacuation of air from each container; introducing into the containers a preserving gas such that the introduced gas expands in and expels air from those portions of the containers which are not filled with goods by causing air to leave the containers along the respective paths; thereafter completing the attachment of closures to the respective containers so as to seal said paths and thus seal the goods and the introduced gases from the surrounding atmosphere; confining the containers in a body of preserving gas at least during expulsion of air from the containers; transporting the containers through a chamber upon completion of said introducing step; maintaining a pressure in the chamber at a value at which at least some of the introduced preserving gas is caused to leave the respective container until the pressure in the container drops to a preselected value; establishing in the containers a pressure which at least approximates atmospheric pressure not later than on completion of said attachment completing step; and maintaining the preserving gas at a temperature below that of the surrounding atmosphere, at least in the course of said introducing step.

2. The method of claim 1, further comprising the step of transporting the containers seriatim along a predetermined path having a first portion in which the gas is introduced into successive containers and at least one second portion in which the attachment of closures to the respective containers is completed.

3. The method of claim 1, wherein the preserving gas is introduced in liquefied form.

4. The method of claim 3, wherein said introducing step includes admitting liquefied preserving gas above the perishable goods in the regions of the tops of the respective containers.

5. The method of claim 1, wherein the preserving gas is inert to foodstuffs.

6. The method of claim 1, wherein the preserving gas contains nitrogen.

7. The method of claim 1, wherein the preserving gas is carbon dioxide.

8. The method of claim 1, wherein the preserving gas is a noble gas.

9. The method of claim 1, wherein the preserving gas is a mixture of at least two gaseous components.

10. The method of claim 1, wherein each closure contains at least one foil.

11. The method of claim 1, wherein each closure consists at least partially of a plastic material.

12. The method of claim 1, wherein each closure consists at least partially of a metallic material.

13. The method of claim 1, wherein each closure includes a fluidtight foil.

14. The method of claim 1 of preserving goods which are stored in containers having rims surrounding the respective open tops, wherein at least one of said partially attaching and attachment completing steps includes bonding the closures to the rims of the respective containers.

15. The method of claim 1 of preserving goods which are stored in containers having rims surrounding the respective open tops, wherein at least one of said partially attaching and attachment completing steps includes adhesively securing the closures to the rims of the respective containers.

16. The method of claim 1 of preserving goods which are stored in containers having rims surrounding the respective open tops, wherein at least one of said attaching and attachment completing steps includes mechanically securing the closures to the rims of the respective containers.

17. The method of claim 1 of preserving goods which are stored in containers having rims surrounding the respective open tops, wherein said partial attachment includes sealing securing the closures to portions of the respective rims.

18. The method of claim 1 of preserving goods which are stored in containers having rims surrounding the respective open tops, wherein said introducing step includes placing a conduit between the rim of a container and the respective closure not later than upon completion of partial attachment, and admitting the preserving gas into the container by way of the conduit.

19. The method of claim 1, further comprising the step of subdividing the chamber into a series of compartments, and said transporting step including conveying the containers through successive compartments of the chamber.

20. The method of claim 1, wherein said confining step comprises admitting protective gas into the chamber.

21. The method of claim 1, further comprising the step of heating a portion at least of the chamber.

22. The method of claim 1, further comprising the step of monitoring at least one parameter of the gas in the chamber.

23. The method of claim 1, further comprising the steps of transporting the containers along a predetermined path and interrupting said transporting step along said predetermined path in the course of at least one of the steps including said introducing and said attachment completing steps.

24. The method of claim 23, wherein said transporting step along said predetermined path includes advancing containers in stepwise fashion.

25. The method of claim 23, wherein said transporting step along said predetermined path includes conveying a file of successive containers along said predetermined path in stepwise fashion so that intervals of transport alternate with intervals of dwell and each next-following container of the file occupies the position previously occupied by the immediately preceding container during successive intervals of dwell.

26. The method of claim 1, further comprising the step of admitting perishable goods into the containers prior to said introducing step, said step of confining the containers in a body of preserving gas being carried out prior to said attachment completing step and the transporting step including conveying the containers in a gas-filled chamber.

* * * * *